US009807534B2

(12) United States Patent
Schneider et al.

(10) Patent No.: US 9,807,534 B2
(45) Date of Patent: Oct. 31, 2017

(54) DEVICE AND METHOD FOR DECORRELATING LOUDSPEAKER SIGNALS

(71) Applicant: Fraunhofer-Gesellschaft zur Foerderung der angewandten Forschung e.V., Munich (DE)

(72) Inventors: Martin Schneider, Erlangen (DE); Walter Kellermann, Eckental (DE); Andreas Franck, Illmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 50 days.

(21) Appl. No.: 15/067,466

(22) Filed: Mar. 11, 2016

(65) Prior Publication Data

US 2016/0198280 A1 Jul. 7, 2016

Related U.S. Application Data

(63) Continuation of application No. PCT/EP2014/068503, filed on Sep. 1, 2014.

(30) Foreign Application Priority Data

Sep. 11, 2013 (DE) ..... 10 2013 218 176

(51) Int. Cl.
*H04R 5/00* (2006.01)
*H04S 3/02* (2006.01)
(Continued)

(52) U.S. Cl.
CPC ..... *H04S 3/02* (2013.01); *H04R 5/04* (2013.01); *H04S 5/00* (2013.01); *H04S 7/301* (2013.01);
(Continued)

(58) Field of Classification Search
CPC ..... H04S 5/00; H04S 2400/11; H04S 3/008; H04S 7/302; H04S 2420/07; H04S 3/02;
(Continued)

(56) References Cited

U.S. PATENT DOCUMENTS

2006/0280311 A1 12/2006 Beckinger et al.
2010/0014692 A1 1/2010 Schreiner et al.
(Continued)

FOREIGN PATENT DOCUMENTS

DE 10355146 7/2005
EP 1855457 11/2007
(Continued)

OTHER PUBLICATIONS

Ahrens, Jens et al., "Introduction to the SoundScape Renderer (SSR)", https://dev.qu.tu-berlin/de/attachments/download/1283/SoundScapeRenderer-0.3.4—manual.pdf, Nov. 13, 2012, pp. 1-38.
(Continued)

*Primary Examiner* — Paul S Kim
(74) *Attorney, Agent, or Firm* — Michael A. Glenn; Perkins Coie LLP

(57) ABSTRACT

A device for generating a multitude of loudspeaker signals based on a virtual source object which has a source signal and a meta information determining a position or type of the virtual source object. The device has a modifier configured to time-varyingly modify the meta information. In addition, the device has a renderer configured to transfer the virtual source object and the modified meta information to form a multitude of loudspeaker signals.

13 Claims, 6 Drawing Sheets

(51) Int. Cl.

| | |
|---|---|
| ***H04R 5/04*** | (2006.01) |
| ***H04S 5/00*** | (2006.01) |
| *H04R 3/02* | (2006.01) |
| *H04R 3/04* | (2006.01) |
| *H04S 3/00* | (2006.01) |
| *H04S 7/00* | (2006.01) |

(52) U.S. Cl.
CPC ..... *H04S 7/302* (2013.01); *H04S 7/305* (2013.01); *H04S 7/40* (2013.01); *H04R 3/02* (2013.01); *H04R 3/04* (2013.01); *H04S 3/008* (2013.01); *H04S 7/303* (2013.01); *H04S 2400/11* (2013.01); *H04S 2420/05* (2013.01); *H04S 2420/07* (2013.01); *H04S 2420/11* (2013.01); *H04S 2420/13* (2013.01)

(58) Field of Classification Search
CPC . H04S 7/305; H04S 7/301; H04S 7/40; H04S 7/303; H04S 2420/11; H04S 2420/13; H04S 2420/05; H04R 5/04; H04R 3/04; H04R 3/02
USPC ..... 381/17
See application file for complete search history.

(56) References Cited

U.S. PATENT DOCUMENTS

| | | | | |
|---|---|---|---|---|
| 2010/0208905 | A1 | 8/2010 | Franck et al. | |
| 2012/0039477 | A1 | 2/2012 | Schijers et al. | |
| 2012/0155653 | A1 | 6/2012 | Jax et al. | |
| 2012/0177204 | A1 | 7/2012 | Hellmuth et al. | |
| 2012/0308049 | A1* | 12/2012 | Schreiner ..... | H04S 3/008 381/119 |

FOREIGN PATENT DOCUMENTS

| | | | |
|---|---|---|---|
| EP | 2146522 | | 1/2010 |
| EP | 2466864 | | 6/2012 |
| JP | 2008118559 | A | 5/2008 |
| JP | 2010539833 | A | 12/2010 |
| JP | 2011528200 | A | 11/2011 |
| JP | 2012133366 | A | 7/2012 |
| JP | 2012525051 | A | 10/2012 |
| JP | 2012530952 | A | 12/2012 |
| WO | WO-2010149700 | | 12/2010 |
| WO | 2013006325 | A1 | 1/2013 |

OTHER PUBLICATIONS

Ali, Murtaza , "Stereophonic Acoustic Echo Cancellation System Using Time-Varying All-Pass Filtering for Signal Decorrelation", IEEE International Conference on Acoustics, Speech, and Signal Processing (ICASSP '98) vol. 6 Seattle, WA, May 1998, pp. 3689-8692.

Benesty, Jacob et al., "A Better Understanding and an Improved Solution to the Specific Problems of Stereophonic Acoustic Echo Cancellation", IEEE Transactions on Speech Audio Processing; vol. 6, No. 2, Mar. 1998, pp. 156-165.

Berkhout, A.J. et al., "Acoustic control by wave field synthesis", Journal, Acoustical Society of America; vol. 93, No. 5, May 1993, pp. 2764-2778.

Blauert, Jens , "Spatial Hearing: The Psychophysics of Human Sound Localization", Chapters 2.3 and 3 and 3.1; The MIT Press, Cambridge, Massachusetts, 1997, pp. 93-137, 202-237.

Buchner, H. et al., "Multichannel Frequency Domain Adaptive Algorithms with Application to Acoustic Echo Cancellation", In: Benesty, J.; Huang, Y.: Adaptive Signal Processing: Application to Real-World Problems; Chapter 4; Berlin : Springer, 2003, pp. 95-129.

Buchner, Herbert et al., "Full-Duplex Communication Systems Using Loudspeaker Arrays and Microphone Arrays", IEEE Int'l. Conf. on Multimedia and Expo; vol. 1, 2002, pp. 509-512.

Daniel, Jerome , "Spatial Sound Encoding Including Near Field Effect: Introducing Distance Coding Filters and a Viable, New Ambisonic Format", AES 23rd International Conference, Copenhagen, Denmark, May 23-25, 2003, pp. 1-15.

Elen, Richard , "The Gentle Art of Room Correction", https://www.meridian-audio.com/meridian-uploads/w_paper/Room_Correction_prt.pdf, Dec. 31, 2003, pp. 1-12.

Gaensler, Tomas et al., "Influence of audio coding on stereophonic acoustic echo cancellation", IEEE International Conference on Acoustics, Speech, and Signal Processing (ICASSP '98), May 1998, pp. 3649-3652.

Gerzon, M. , "Digital room equalisation", Internet citation, http://www.audiosignal.co.uk/Resources/Digtal_room_equalisation_A4.pd f, Jan. 2, 2005, 9 pages.

Gilloire, Andre et al., "Using auditory properties to improve the behaviour of stereophonic acoustic echo cancellers", IEEE International Conference on Acoustics, Speech, and Signal Processing (ICASSP '98), May 1998, pp. 3681-3684.

Herre, Juergen et al., "Acoustic Echo Cancellation for Surround Sound Using Perceptually Motivated Convergence Enhancement", IEEE International Conference on Acoustics, Speech, and Signal Processing (ICASSP 2007), Honolulu, Hawaii, Apr. 2007, pp. I-17, I-20.

Morgan, Dennis R. et al., "Investigation of Several Types of Nonlinearities for Use in Stereo Acoustic Echo Cancellation", IEEE Transactions on Speech and Audio Processing, vol. 9, No. 6, Sep. 2001, pp. 686-696.

Schneider, Martin et al., "Adaptive Listening Room Equalization Using a Scalable Filtering Structure in the Wave Domain", IEEE Int'l Conference on Acoustics, Speech and Signal Processing (ICASSP 2012), http://ieeeplore.ieee.org/stamp/stamp.jsp?arnumber=6287805 [retrieved Feb. 19, 2015], Mar. 27, 2012, pp. 13-16.

Schneider, Martin et al., "Wave-domain loudspeaker signal decorrelation for system identification in multichannel audio reproduction scenarios", ICASSP 91: 1991 International Conference on Acoustics, Speech, and Signal Processing, Institute of Electrical and Electronics Engineers, Piscataway, NJ, US, May 26, 2013, pp. 605-609.

Sondhi, M. M. et al., "Stereophonic Acoustic Echo Cancellation—An Overview of the Fundamental Problem", IEEE Signal Processing Letters; vol. 2, No. 8, Aug. 1995, pp. 148-151.

Spors, S et al., "A novel approach to active listening room compensation for wave field synthesis using wave-domain adaptive filtering", IEEE Int'l Conf. on Acoustics, Speech, and Signal Processing, 2004. Proceedings; Montreal, Quebec, Canada, May 2004, pp. IV 29-32.

Verron, Charles et al., "A 3-D Immersive Synthesizer for Environmental Sounds", IEEE Transactions on Audio, Speech, and Language Processing, vol. 18, No. 6., Aug. 2010, pp. 1550-1561.

Wung, Jason et al., "Inter-channel decorrelation by sub-band resampling in frequency domain", IEEE Int'l. Conf. on Acoustics, Speech and Signal Processing; Kyoto, Japan, Mar. 2012, pp. 29-32.

Ziemer, Tim , "Psychoacoustic Approach to Wave Field Synthesis", AES 42nd Int'l Conf.: Semantic Audio, Jul. 2011, 8 pages.

Ahrens, Jens et al., "Introduction to the SoundScape Renderer (SSR)", retrieved from the Internet, Germany, SoundScapeRenderer@telecom.de, May 3, 2011, p. 31 I.24-30.

* cited by examiner

ERLE in dB
60
40
20
0

$\Delta_h(n)$ in dB
0
-5
-10
-15

$\varphi_a$
1
0,5
0
-0,5
-1
0
5
10
15
20
25
30
$L_p$

① $\varphi_a = \pi/48$ ② $\varphi_a = 4\pi/48$ ③ $\varphi_a = 8\pi/48$ ④ $\varphi_a = 0$

DEVICE AND METHOD FOR DECORRELATING LOUDSPEAKER SIGNALS

CROSS-REFERENCE TO RELATED APPLICATIONS

This application is a continuation of copending International Application No. PCT/EP2014/068503, filed Sep. 1, 2014, which claims priority from German Application No. 10 2013 218 176.0, filed Sep. 11, 2013, which are each incorporated herein in its entirety by this reference thereto.

BACKGROUND OF THE INVENTION

The invention relates to a device and a method for decorrelating loudspeaker signals by altering the acoustic scene reproduced.

For a three-dimensional hearing experience, it may be intended to give the respective listener of an audio piece or viewer of a movie a more realistic hearing experience by means of three-dimensional acoustic reproduction, for example by acoustically giving the listener or viewer the impression of being located within the acoustic scene reproduced. Psycho-acoustic effects may also be made use of for this. Wave field synthesis or higher-order ambisonics algorithms may be used in order to generate a certain sound field within a playback or reproduction space using a number or multitude of loudspeakers. The loudspeakers here may be driven such that the loudspeakers generate wave fields which completely or partly correspond to acoustic sources arranged at nearly any location of an acoustic scene reproduced.

Wave field synthesis (WFS) or higher-order ambisonics (HOA) allow a high-quality spatial hearing impression for the listener by using a large number of propagation channels in order to spatially represent virtual acoustic source objects. In order to achieve a more immersive user experience, these reproduction systems may be complemented by spatial recording systems so as to allow further applications, such as, for example, interactive applications, or improve the reproduction quality. The combination of the loudspeaker array, the enclosing space or volume, such as, for example, a playback space, and the microphone array is referred to as loudspeaker enclosure microphone system (LEMS) and is identified in many applications by simultaneously observing loudspeaker signals and microphone signals. However, it is known already from stereophonic acoustic echo cancellation (AEC) that the typically strong cross-correlations of the loudspeaker signals may inhibit sufficient system identification, as is described, for example, in [BMS98]. This is referred to as the non-uniqueness problem. In this case, the result of the system identification is only one of an indefinite number of solutions determined by the correlation characteristics of the loudspeaker signals. The result of this incomplete system identification nevertheless describes the behavior of the true LEMS for the current loudspeaker signals and may thus be used for different adaptive filtering applications, for example AEC or listening room equalization (LRE). However, this result will no longer be true when the cross-correlation characteristics of the loudspeaker signals change, thereby causing the behavior of the system, which is based on these adapted filters, to become unstable. This lacking robustness constitutes a major obstacle to the applicability of many technologies, such as, for example, AEC or adaptive LRE.

An identification of a loudspeaker enclosure microphone system (LEMS) may be necessitated for many applications in the field of acoustic reproduction. With a large number of propagation paths between loudspeakers and microphones, as may, for example, apply for wave field synthesis (WFS), this problem may be particularly challenging due to the non-uniqueness problem, i.e. due to an under-determined system. When, in an acoustic playback or reproduction scene, fewer virtual sources are represented than the reproduction system comprises loudspeakers, this non-uniqueness problem may arise. In such a case, the system may no longer be identified uniquely and methods including system identification suffer from small or low robustness or stability to varying correlation characteristics of the loudspeaker signals. A current measure against the non-uniqueness problem entails modifying the loudspeaker signals (i.e. decorrelation) so that the system or LEMS may be identified uniquely and/or the robustness is increased under certain conditions. However, most approaches known may reduce audio quality and may even interfere in the wave field synthesized, when being applied in wave field synthesis.

For the purpose of decorrelating loudspeaker signals, three possibilities are known to increase the robustness of system identification, i.e. identification or estimation of the real LEMS:

[SMH95], [GT98] and [GE98] suggest adding noise, which is independent of different loudspeaker signals, to the loudspeaker signals. [MHBOI], [BMS98] suggest different non-linear pre-processing for every reproduction channel. In [Ali98], [HBK07], different time-varying filtering is suggested for each loudspeaker channel. Although the techniques mentioned in the ideal case are not to impede the sound quality perceived, they are generally not well suitable for WFS: Since the loudspeaker signals for WFS are determined analytically, time-varying filtering may significantly interfere in the wave field reproduced. When high quality of the audio reproduction is strived for, a listener may not accept noise signals added or non-linear pre-processing, which both may reduce audio quality. In [SHK13], an approach suitable for WFS is suggested, in which the loudspeaker signals are pre-filtered such that an alteration of the loudspeaker signals as a time-varying rotation of the wave field reproduced is obtained.

SUMMARY

According to an embodiment, a device for generating a multitude of loudspeaker signals based on at least one virtual source object which has a source signal and meta information determining a position or type of the at least one virtual source object may have: a modifier configured to time-varyingly modify the meta information; and a renderer configured to transfer the at least one virtual source object and the modified meta information in which the type or position of the at least one virtual source object is modified time-varyingly, to form a multitude of loudspeaker signals.

According to another embodiment, a method for generating a multitude of loudspeaker signals based on at least one virtual source object which has a source signal and meta information determining the position or type of the at least one virtual source object may have the steps of: time-varyingly modifying the meta information; and transferring the at least one virtual source object and the modified information in which the type or position of the at least one virtual source object is modified time-varyingly, to form a multitude of loudspeaker signals.

Another embodiment may have a computer program having a program code for performing the above method when the program runs on a computer.

The central idea of the present invention is having recognized that the above object may be solved by the fact that decorrelated loudspeaker signals may be generated by time-varying modification of meta information of a virtual source object, like the position or type of the virtual source object.

In accordance with an embodiment, a device for generating a plurality of loudspeaker signals comprises a modifier configured to time-varyingly modify meta information of a virtual source object. The virtual source object comprises meta information and a source signal.

The meta information determine, for example, characteristics, like a position or type of the virtual source object. By modifying the meta information, the position or the type, like an emission characteristic, of the virtual source object may be modified. The device additionally comprises a renderer configured to transfer the virtual source object and the modified meta information to form a multitude of loudspeaker signals. By time-varyingly modifying the meta information, decorrelation of the loudspeaker signals may be achieved such that a stable, i.e. robust, system identification may be provided so as to allow more robust LRE or more robust AEC based on the improved system identification, since the robustness of LRE and/or AEC depends on the robustness of the system identification. More robust LRE or AEC in turn may be made use of for an improved reproduction quality of the loudspeaker signals.

Of advantage with this embodiment is the fact that decorrelated loudspeaker signals may be generated by means of the renderer based on the time-varyingly modified meta information such that an additional decorrelation by additional filtering or addition of noise signals may be dispensed with.

An alternative embodiment provides a method for generating a plurality of loudspeaker signals based on a virtual source object which comprises a source signal and meta information determining the position and type of the virtual source object. The method includes time-varyingly modifying the meta information and transferring the virtual source object and the modified meta information to form a multitude of loudspeaker signals.

Of advantage with this embodiment is the fact that loudspeaker signals which are decorrelated already may be generated by modifying the meta information such that an improved reproduction quality of the acoustic playback scene may be achieved compared to post-decorrelating correlated loudspeaker signals, since an addition of supplementary noise signals or applying non-linear operations can be avoided.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
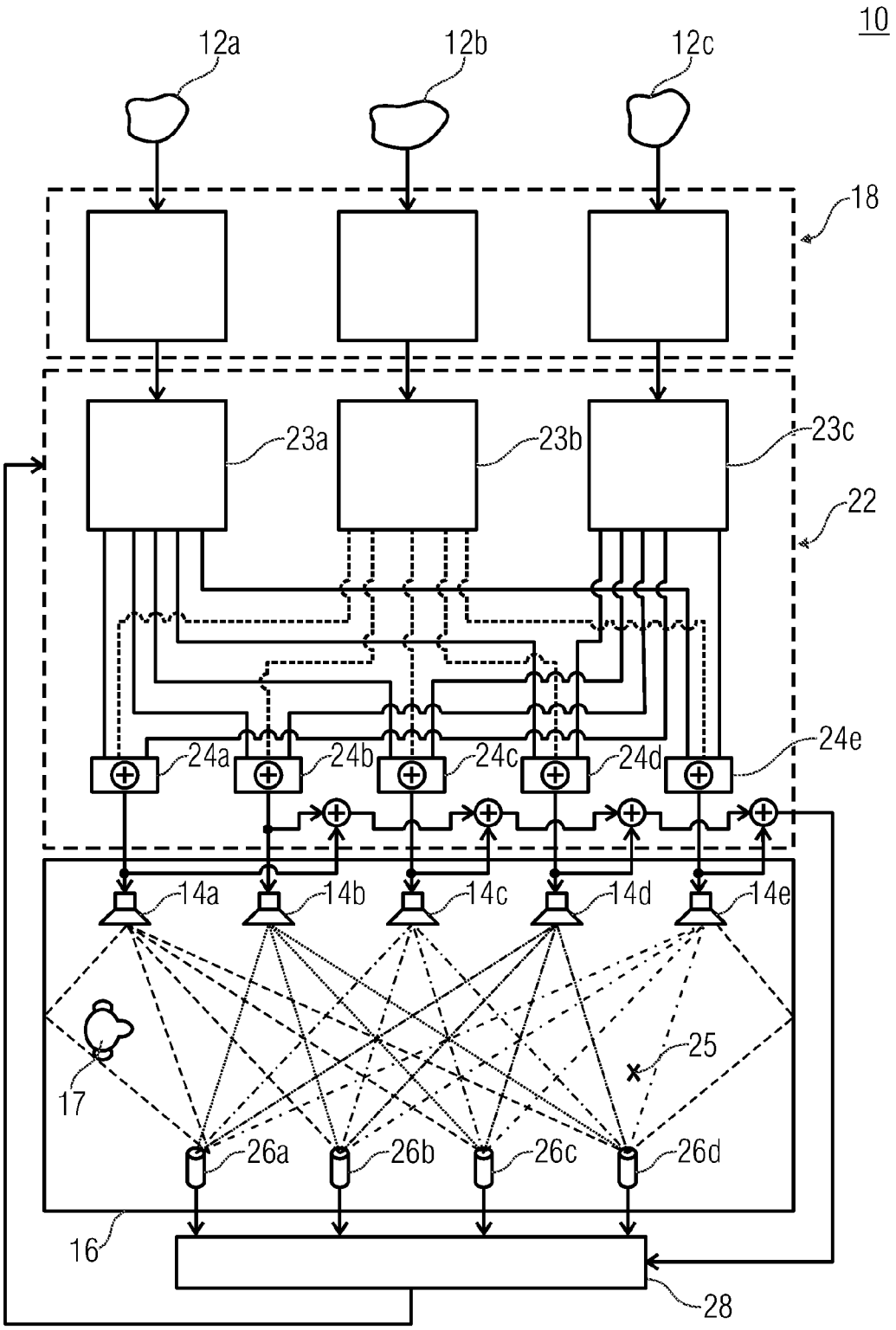
FIG. 1 shows a device for generating a plurality of decorrelated loudspeaker signals based on virtual source objects.

Before embodiments of the present invention will be detailed subsequently referring to the drawings, it is pointed out that identical elements, objects and/or structures or that of equal function or equal effect are provided with same reference numerals in the different Figures such that the description of these elements given in different embodiments is mutually exchangeable or mutually applicably.

FIG. 1 shows a device 10 for generating a plurality of decorrelated loudspeaker signals based on virtual source objects 12*a*, 12*b* and/or 12*c*. A virtual source object may be any type of noise-emitting objects, bodies or persons, like one or several persons, musical instruments, animals, plants, apparatuses or machines. The virtual source objects 12*a-c* may be elements of an acoustic playback scene, like an orchestra performing a piece of music. With an orchestra, a virtual source object may, for example, be an instrument or a group of instruments. In addition to a source signal, like a mono signal of a tone or noise reproduced or a sequence of tones or noise of the virtual source object 12*a-c*, meta information may also be associated to a virtual source object. The meta information may, for example, include a location of the virtual source object within the acoustic playback scene reproduced by a reproduction system. Exemplarily, this may be a position of a respective instrument within the orchestra reproduced. Alternatively or additionally, the meta information may also include a directional or emission or radiation characteristic of the respective virtual source object, like information on which direction the respective source signal of the instrument is played to. When an instrument of an orchestra is, for example, a trumpet, the trumpet sound may be emitted in a certain direction (the direction which the bell is directed to). When, alternatively, the instrument is, for example, a guitar, the guitar emits at larger an emission angle compared to the trumpet. The meta information of a virtual source object may include the emission characteristic and the orientation of the emission characteristic in the playback scene reproduced. The meta information may, alternatively or additionally, also include a spatial extension of the virtual source object in the playback scene reproduced. Based on the meta information and the source signal, a virtual source object may be described in two or three dimensions in space.

A playback scene reproduced may, for example, also be an audio part of a movie, i.e. the sound effects of the movie. A playback scene reproduced may, for example, match partly or completely with a movie scene such that the virtual source object may exemplarily be a person positioned in the playback space and talking in dependence on the direction, or an object moving in the space of the playback scene reproduced while emitting noises, like a train or car.

The device 10 is configured to generate loudspeaker signals for driving loudspeakers 14*a-e*. The loudspeakers 14*a-e* may be arranged at or in a playback space 16. The playback space 16 may, for example, be a concert or movie hall where a listener or viewer 17 is located. By generating and reproducing the loudspeaker signals at the loudspeakers 14*a-e*, a playback scene which is based on the virtual source objects 12*a-c* may be reproduced in the playback space 16. The device 10 includes a modifier 18 configured to time-varyingly modify the meta information of one or several of the virtual source objects 12*a-c*. The modifier 18 is also configured to modify the meta information of several virtual source objects individually, i.e. for each virtual source object 12*a-c*, or for several virtual source objects. The modifier 18 is, for example, configured to modify the position of the virtual source object 12*a-c* in the playback scene reproduced or the emission characteristic of the virtual source object 12*a-c*.

In other words, applying decorrelation filters may cause an uncontrollable change in the scene reproduced when loudspeaker signals are decorrelated without considering the resulting acoustic effects in the playback space, whereas the device 10 allows a natural, i.e. controlled change of the virtual source objects. A time-varying alteration of the rendered, i.e. reproduced acoustic scene by a modification of the meta information such that the position or the emission characteristic, i.e. the type of source, of one or several virtual source objects 12*a-c*. This may be allowed by accessing the reproduction system, i.e. by arranging the modifier 18. Modifications of the meta information of the virtual source objects 12*a-c* and, thus, of the acoustic playback scene reproduced may be checked intrinsically, i.e. within the system, such that the effects occurring by modification may be limited, for example in that the effects occurring are not perceived or are not perceived as being disturbing by the listener 17.

The device 10 includes a renderer 22 configured to transfer the source signals of the virtual source objects 12*a-c* and the modified meta information to form a multitude of loudspeaker signals. The renderer 22 comprises component generators 23*a-c* and signal component processors 24*a-e*. The renderer 22 is configured to transfer, by means of the component generators 23*a-c*, the source signal of the virtual source object 12*a-c* and the modified meta information to form signal components such that a wave field may be generated by the loudspeakers 14*a-e* and the virtual source object 12*a-c* may be represented by the wave field at a position 25 within the acoustic playback scene reproduced. The acoustic playback scene reproduced may be arranged at least partly within or outside the playback space 16. The signal component processors 24*a-e* are configured to process the signal components of one or several virtual source objects to form loudspeaker signals for driving the loudspeakers 14*a-e*. A multitude of loudspeakers of, for example, more than 10, 20, 30, 50, 300 or 500, may be arranged or be applied at or in a playback space 16, for example in dependence on the playback scene reproduced and/or a size of the playback space 16. In other words, the renderer may be described to be a multiple input (virtual source objects) multiple output (loudspeaker signals) (MIMO) system which transfers the input signals of one or several virtual source objects to form loudspeaker signals. The component generators and/or the signal component processors may alternatively also be arranged in two or several separate components.

Alternatively or additionally, the renderer 22 may perform pre-equalization such that the playback scene reproduced is replayed in the playback space 16 as if it were replayed in a free-field environment or in a different type of environment, like a concert hall, i.e. the renderer 22 can compensate distortions of acoustic signals caused by the playback space 16 completely or partly, like by pre-equalization. In other words, the renderer 22 is configured to produce loudspeaker signals for the virtual source object 12*a-c* to be represented.

When several virtual source objects 12*a-c* are transferred to form loudspeaker signals, a loudspeaker 14*a-e* can reproduce at a certain time drive signals which are based on several virtual source objects 12*a-c*.

The device 10 includes microphones 26*a-d* which may be applied at or in the playback space 16 such that the wave fields generated by the loudspeakers 14*a-e* may be captured by the microphones 26*a-d*. A system calculator 28 of the device 10 is configured to estimate a transmission characteristic of the playback space 16 based on the microphone signals of the plurality of microphones 26*a-d* and the loudspeaker signals. A transmission characteristic of the playback space 16, i.e. a characteristic of how the playback space 16 influences the wave fields generated by the loudspeakers 14*a-e*, may, for example, be caused by a varying number of persons located in the replace space 16, by changes of furniture, like a varying backdrop of the replace space 16 or by a varying position of persons or objects within the replace space 16. Reflection paths between loudspeakers 14*a-e* and microphones 26*a-d* may, for example, be blocked or generated by an increasing number of persons or objects in the playback space 16. The estimation of the transmission characteristic may also be represented as system identification. When the loudspeaker signals are correlated, the non-uniqueness problem may arise in system identification.

The renderer 22 may be configured to implement a time-varying rendering system based on the time-varying transmission characteristic of the playback space 16 such that an altered transmission characteristic may be compensated and a decrease in audio quality be avoided. In other words, the renderer 22 may allow adaptive equalization of the playback space 16. Alternatively or additionally, the renderer 22 may be configured to superimpose the loudspeaker signals generated by noise signals, to add attenuation to the loudspeaker signals and/or delay the loudspeaker signals by filtering the loudspeaker signals, for example using a decorrelation filter. A decorrelation filter may, for example, be used for a time-varying phase shift of the loudspeaker signals. Additional decorrelation of the loudspeaker signals may be achieved by a decorrelation filter and/or the addition of noise signals, for example when meta information in a virtual source object 12*a-c* are modified by the modifier 18 to a minor extent only such that the loudspeaker signals generated by the renderer 22 are correlated by a measure which is to be reduced for a playback scene.

Decorrelation of the loudspeaker signals and, thus, decreasing or avoiding system instabilities may be achieved by modifying the meta information of the virtual source objects 12*a-c* by means of the modifier 18. System identification may be improved by, for example, making use of an alteration, i.e. modification of the spatial characteristics of the virtual source objects 12*a-c*.

Compared to an alteration of the loudspeaker signals, the modification of the meta information may take place specifically and be done in dependence on, for example, psychoacoustic criteria such that the listener 17 of the playback scene reproduced does not perceive a modification or does not perceive same as being disturbing. A shift of the position 25 of a virtual source object 12*a-c* in the playback scene reproduced may, for example, result in altered loudspeaker signals and, thus, in a complete or partial decorrelation of the loudspeaker signals such that adding noise signals or applying non-linear filter operations, like in decorrelation filters, can be avoided. When, for example, a train is represented in the playback scene reproduced, it may, for example, remain unnoticed by the listener 17 when the respective train is shifted by 1, 2 or 5 m, for example, in space with a greater distance to the listener 17, like 200, 500 or 1000 m.

Multi-channel reproduction systems, like WFS, as is, for example, suggested in [BDV93], higher-order ambisonics (HOA), as is, for example, suggested in [Dan03], or similar methods may reproduce wave fields with several virtual sources or source objects, among other things by representing the virtual source objects in the form of point sources, dipole sources, sources of kidney-shaped emission characteristics, or sources emitting planar waves. When these sources exhibit stationary spatial characteristics, like fixed positions of the virtual source objects or non-varying emission or directional characteristics, a constant acoustic playback scene may be identified when a corresponding correlation matrix is full-rank, as is discussed in detail in FIG. 6.

The device 10 is configured to generate a decorrelation of the loudspeaker signals by modifying the meta information of the virtual source objects 12*a-c* and/or to consider a time-varying transmission characteristic of the playback space 16.

The device represents a time-varying alteration of the acoustic playback scene reproduced for WFS, HOA or similar reproduction models in order to decorrelate the loudspeaker signals. Such a decorrelation may be useful when the problem of system identification is under-determined. In contrast to known solutions, the device 10 allows a controlled alteration of the playback scene reproduced in order to achieve high quality of WFS or HOA reproduction.

Figure 2:
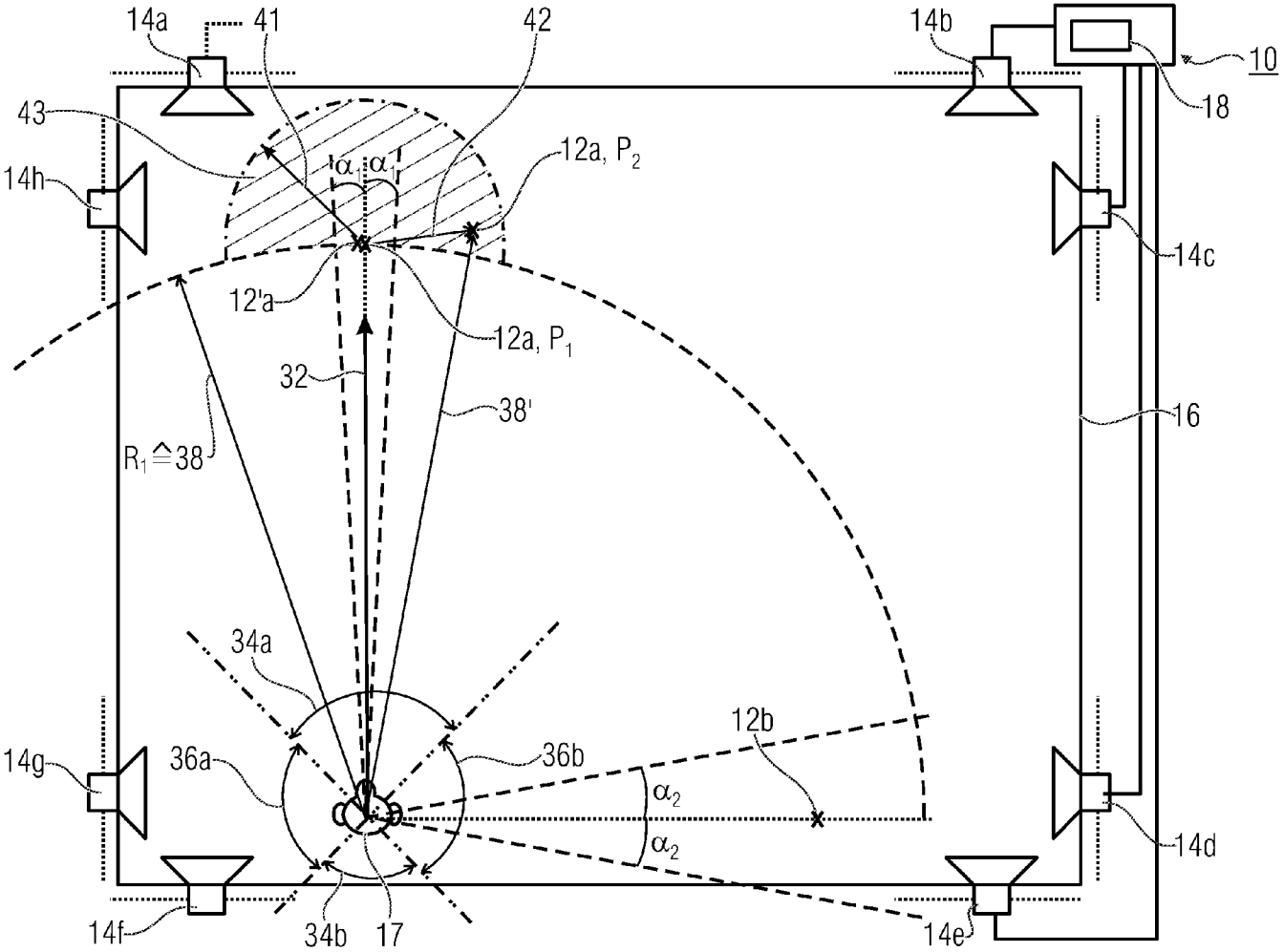
FIG. 2 shows a schematic top view of a playback space where loudspeakers are arranged.

FIG. 2 shows a schematic top view of a playback space 16 where loudspeakers 14*a-h* are arranged. The device 10 is configured to produce loudspeaker signals based on one or several virtual source objects 12*a* and/or 12*b*. A perceivable modification of the meta information of the virtual source objects 12*a* and/or 12*b* may be perceived by the listener as being disturbing. When, for example, a location or position of the virtual source object 12*a* and/or 12*b* is altered too much, the listener may, for example, have the impression that an instrument of an orchestra is moving in space. Alternatively, when the playback scene reproduced belongs to a movie, the result may be an acoustic impression of the virtual source object 12*a* and/or 12*b* moving at an acoustic speed differing from an optical speed of an object implied by the sequence of pictures, such that the virtual source object moves at a different speed or in a different direction, for example. A perceivable impression or impression perceived as being disturbing may be reduced or prevented by altering the meta information of a virtual source object 12*a* and/or 12*b* within certain intervals or tolerances.

Spatial hearing in a median plane, i.e. in a horizontal plane of the listener 17, may be important for perceiving acoustic scenes, whereas spatial hearing in the sagittal plane i.e. a plane separating the left and right body halves of the listener 17 in the center, may be of minor relevance. For reproduction systems configured to reproduce three-dimensional scenes, the playback scene may additionally be altered in the third dimension. Localizing acoustic sources by the listener 17 may be more imprecise in the sagittal plane than in the median plane. It is conceivable to maintain or extend threshold values defined subsequently for two dimensions (horizontal plane) for the third dimension also, since threshold values derived from a two-dimensional wave field are very conservative lower thresholds for possible alterations of the rendered scene in the third dimension. Although the following discussions emphasize perception effects in two-dimensional playback scenes in the median plane, which are criteria of optimization for many reproduction systems, what is discussed also applies to three-dimensional systems.

In principle, different types of wave fields may be reproduced, like, for example, wave fields of point sources, planar waves or wave fields of general multi-pole sources, like dipoles. In a two-dimensional plane, i.e. while considering only two dimensions, the perceived position of a point source or a multi-pole source may be described by a direction and a distance, whereas planar waves may be described by an incident direction. The listener 17 may localize the direction of a sound source by two spatial trigger stimuli, i.e. interaural level differences (ILDs) and interaural time differences (ITDs). The modification of the meta information of a respective virtual source object may result in a change in the respective ILDs and/or in a change in the respective ITDs for the listener 17.

The distance of a sound source may be perceived already by the absolute monaural level, as is described in [Bla97]. In other words, the distance may be perceived by a loudness and/or a change in distance by a change in loudness.

The interaural level difference describes a level difference between both ears of the listener 17. An ear facing a sound source may be exposed to higher a sound pressure level than an ear facing away from the sound source. When the listener 17 turns his or her head until both ears are exposed to roughly the same sound pressure level and the interaural level difference is only small, the listener may be facing the sound source or, alternatively, be positioned with his or her back to the sound source. A modification of the meta information of the virtual source object 12*a* or 12*b*, for example such that the virtual source object is represented at a different location or comprises a varying directionality, may result in a different change in the respective sound pressure levels at the ears of the listener 17 and, thus, in a change in the interaural level difference, wherein said alteration may be perceivable for the listener 17.

Interaural time differences may result from different run times between a sound source and an ear of a listener 17 arranged at smaller a distance or greater a distance such that a sound wave emitted by the sound source necessitates a greater amount of time to reach the ear arranged at greater a distance. A modification of the meta information of the virtual source object 12*a* or 12*b*, for example such that the virtual source object is represented to be at a different location, may result in a different alteration of the distances between the virtual source object and the two ears of the listener 17 and, thus, an alteration of the interaural time difference, wherein this alteration may be perceivable for the listener 17.

A non-perceivable alteration or non-disturbing alteration of the ILD may be between 0.6 dB and 2 dB, depending on the scenario reproduced. A variation of an ILD by 0.6 dB corresponds to a reduction of the ILD of about 6.6% or an increase by about 7.2%. A change of the ILD by 1 dB corresponds to a proportional increase in the ILD by about 12% or a proportional decrease by 11%. An increase in the ILD by 2 dB corresponds to a proportional increase in the ILD by about 26%, whereas a reduction by 2 dB corresponds to a proportional reduction of 21%. A threshold value of perception for an ITD may be dependent on a respective scenario of the acoustic playback scene and be, for example, 10, 20, 30 or 40 μs. When modifying the meta information of the virtual source object 12*a* or 12*b* only to a small extent, i.e. in the range of ILDs altered by a few 0.1 dB, a change in the ITDs may possibly be perceived earlier by the listener 17 or be perceived as being disturbing, compared to an alteration of the ILD.

The modification of the meta information may influence the ILDs only little when the distance of a sound source to the listener 17 is shifted a little. ITDs may, due to the early perceivability and the linear change with a positional change, represent stronger a limitation for a non-audible or non-disturbing alteration of the playback scene reproduced. When, for example, ITDs of 30 μs are allowed, this may result in a maximum alteration of a source direction between the sound source and the listener 17 of up to $\alpha_1=3°$ for sound sources arranged in the front, i.e. in a direction of vision 32 or a front region 34*a*, 34*b* of the listener 17, and/or an alteration of up to $\alpha_2=10°$ for sound sources arranged laterally, i.e. at the side. A laterally arranged sound source may be located in one of the lateral regions 36*a* or 36*b* extending between the front regions 34*a* and 34*b*. The front regions 34*a* and 34*b* may, for example, be defined such that the front region 34*a* of the listener 17 is in an angle of ±45° relative to the line of vision 32 and the front region 34*b* at ±45° contrary to the line of vision such that the front region 34*b* may be arranged behind the listener. Alternatively or additionally, the front regions 34*a* and 34*b* may also include smaller or greater angles or include mutually different angular regions such that the front region 34*a* includes a larger angular region than the front region 34*b*, for example. Principally, the front regions 34*a* and 34*b* and/or lateral regions 36*a* and 36*b* may be arranged, independent of one another, to be contiguous or to be spaced apart from one another. The direction of vision 32 may, for example, be influenced by a chair or arm chair which the listener 14 sits on, or by a direction in which the listener 17 looks at a screen.

In other words, the device 10 may be configured to consider the direction of vision 32 of the listener 17 so that sound sources arranged in front, like the virtual source object 12*a*, are modified as regards their direction by up to $\alpha_1=3°$, and laterally arranged sound sourced, like the virtual source object 12*b*, by up to $\alpha_2=10°$. Compared to a system as is suggested in [SHK13], the device 10 may allow a source object to be shifted individually relative to the virtual source objects 12*a* and 12*b*, whereas, in [SHK13], only the playback scene reproduced as a whole may be rotated. In other words, a system as is, for example, described in [SHK13] has no information on the scene rendered, but considers information on the loudspeaker signals generated. The device 10 alters the rendered scene known to the device 10.

While alterations of the playback scene reproduced by altering the source direction by 3° or 10° may not be perceivable for the listener 17, it is also conceivable to accept perceivable changes of the playback scene reproduced which may not be perceived as being disturbing. A change of the ITD by up to 40 μs or 45 μs, for example, may be allowed. Additionally, a rotation of the entire acoustic scene by up to 23° may, for example, not be perceived as being disturbing by many or most listeners [SHK13]. This threshold value may be increased by a few to some degrees by an independent modification of the individual sources or directions which the sources are perceived from so that the acoustic playback scene may be shifted by up to 28°, 30° or 32°.

The distance 38 of an acoustic source, like a virtual source object, may possibly be perceived by a listener only imprecisely. Experiments show that a variation of the distance 38 of up to 25% is usually not perceived by listeners or not perceived as being disturbing, which allows a rather strong variation of the source distance, as is described, for example, in [Bla97].

A period or time interval between alterations in the playback scene reproduced may exhibit a constant or variable time interval between individual alterations, like about 5 seconds, 10 seconds or 15 seconds, so as to ensure high audio quality. The high audio quality may, for example, be achieved by the fact that an interval of, for example, about 10 seconds between scene alterations or alterations of meta information of one or several virtual source objects allows a sufficiently high decorrelation of the loudspeaker signals, and that the rareness of alterations or modifications contributes to alterations of the playback scene not to be perceivable or not disturbing.

A variation or modification of the emission characteristics of a general multi-pole source may leave the ITDs uninfluenced, whereas ILDs may be influenced. This may allow any modifications of the emission characteristics which remain unnoticed by a listener 17 or are not perceived as being disturbing as long as the ILDs at the location of a listener are smaller than or equal to the respective threshold value (0.6 dB to 2 dB).

The same threshold values may be determined for a monaural change in level, i.e. relative to an ear of the listener 17.

The device 10 is configured to superimpose an original virtual source object 12*a* by an additional imaged virtual object 12'*a* which emits the same or a similar source signal. In other words, the modifier 18 is configured to produce an image of the virtual source object (12*a*). The imaged virtual source 12'*a* may be arranged roughly at a virtual position $P_1$ where the virtual source object 12*a* is originally arranged. The virtual position $P_1$ has a distance 38 to the listener 17. In other words, the additional imaged virtual source 12'*a* may be an imaged version of the virtual source object 12*a* produced by the modifier 18 so that the imaged virtual source 12'*a* is the virtual source object 12. In other words, the virtual source object 12*a* may be imaged by the modifier 18 to form the imaged virtual source object 12'*a*. The virtual source object 12*a* may be moved, by modification of the meta information, for example, to a virtual position $P_2$ with a distance 42 to the imaged virtual source object 12'*a* and a distance 38' to the listener 17. Alternatively or additionally, it is conceivable for the modifier 18 to modify the meta information of the image 12'*a*.

A region 43 may be represented as a subarea of a circle with a distance 41 around the imaged virtual source object 12'*a* comprising a distance of at least the distance 38 to the listener 17. If the distance 38' between the modified virtual source object 12*a* is greater than the distance 38 between the imaged virtual source 12'*a* so that the modified source object 12*a* is arranged within the region 43, the virtual source object 12*a* may be moved in the region 33 around the imaged virtual source object 12'*a*, without perceiving the imaged virtual source object 12'*a* and the virtual source object 12 as separate acoustic objects. The region 43 may reach up to 5, 10 or 15 m around the imaged virtual source object 12'*a* and be limited by a circle of the radius $R_1$, which corresponds to the distance 38.

Alternatively or additionally, the device 10 may be configured to make use of the precedence effect, also known as the Haas effect, as is described in [Bla97]. In accordance with an observation made by Haas, an acoustic reflection of a sound source which arrives at the listener 17 up to 50 ms after the direct, exemplarily unreflected, portion of the source may be included nearly perfectly into the spatial perception of the original source. This means that two mutually separate acoustic sources may be perceived as one.

Figure 3:
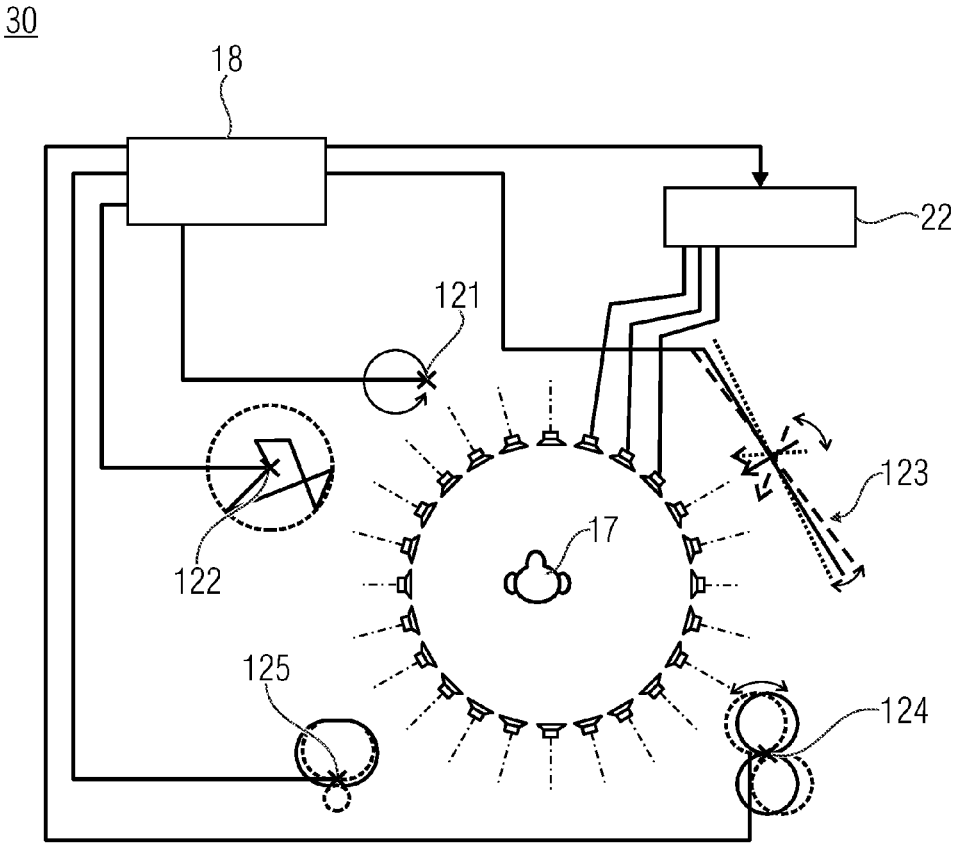
FIG. 3 shows a schematic overview for modifying meta information of different virtual source objects.

FIG. 3 shows a schematic overview of the modification of meta information of different virtual source objects 121-125 in a device 30 for generating a plurality of decorrelated loudspeaker signals. Although FIG. 3 and the respective explanations, for the sake of clear representation, are two-dimensional, all the examples are also valid for three-dimensions.

The virtual source object 121 is a spatially limited source, like a point source. The meta information of the virtual source object 121 may, for example, be modified such that the virtual source object 121 is moved on a circular path over several interval steps.

The virtual source object 122 also is a spatially limited source, like a point source. An alteration of the meta information of the virtual source object 122 may, for example, take place such that the point source is moved in a limited region or volume irregularly over several interval steps. The wave field of the virtual source objects 121 and 122 may generally be modified by modifying the meta information so that the position of the respective virtual source object 121 or 122 is modified. In principle, this is possible for any virtual source objects of a limited spatial extension, like a dipole or a source of a kidney-shaped emission characteristic.

The virtual source object 123 represents a planar sound source and may be varied relative to the planar wave excited. An emission angle of the virtual source object 123 and/or an angle of incidence to the listener 17 may be influenced by modifying the meta information.

The virtual source object 124 is a virtual source object of a limited spatial extension, like a dipole source of a direction-dependent emission characteristic, as is indicated by the circle lines. The direction-dependent emission characteristic may be rotated for altering or modifying the meta information of the virtual source object 124.

For direction-dependent virtual source objects, like, for example, the virtual source object 125 of a kidney-shaped emission characteristic, the meta information may be modified such that the emission pattern is modified in dependence on the respective point in time. For the virtual source object 125, this is exemplarily represented by an alteration from a kidney-shaped emission characteristic (continuous line) to a hyper-kidney-shaped directional characteristic (broken line). For omnidirectional virtual source objects or sound sources, an additional, time-varying, direction-dependent directional characteristic may be added or generated.

The different ways, like altering the position of a virtual source object, like a point source or source of limited spatial extension, altering the angle of incidence of a planar wave, altering the emission characteristic, rotating the emission characteristic or adding a direction-dependent directional characteristic to an omnidirectionally emitting source object, may be combined with one another. Here, the parameters selected or determined to be modified for the respective source object may be optional and mutually different. In addition, the type of alteration of the spatial characteristic and a speed of the alteration may be selected such that the alteration of the playback scene reproduced either remains unnoticed by a listener or is acceptable for the listener as regards its perception. In addition, the spatial characteristics for temporal individual frequency regions may be varied differently.

Figures 5A, 5B, 5C:
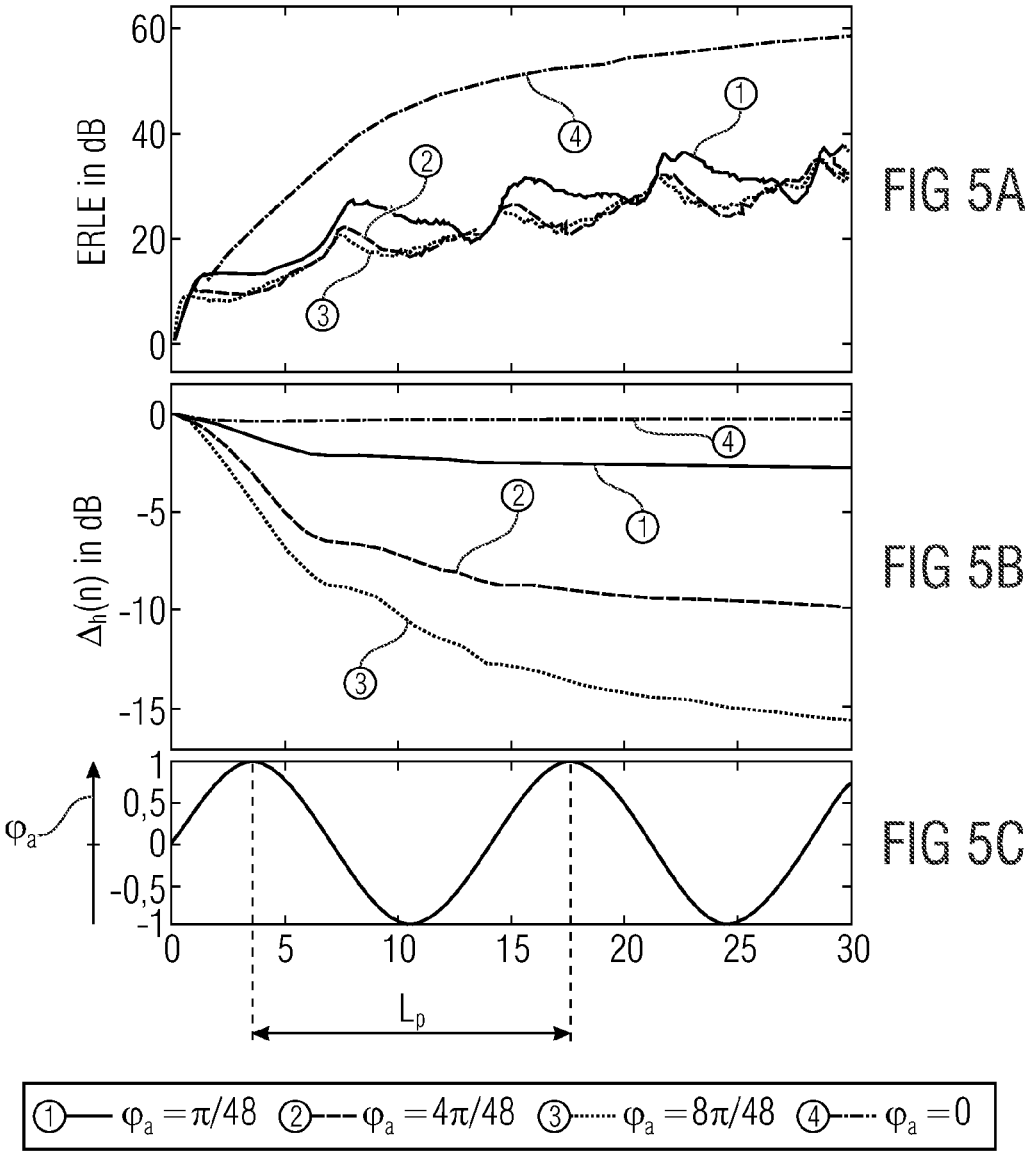
FIG. 5*a* shows the results of echo return loss enhancement (ERLE) achievable for acoustic echo cancellation (AEC) in four plots for four sources of different amplitude oscillations of the prototypes.
FIG. 5*b* shows the normalized system distance for system identification for the amplitude oscillation.
FIG. 5*c* shows a plot where time is indicated on the abscissa and values of the amplitude oscillation are given on the ordinate.
Figure 6A:
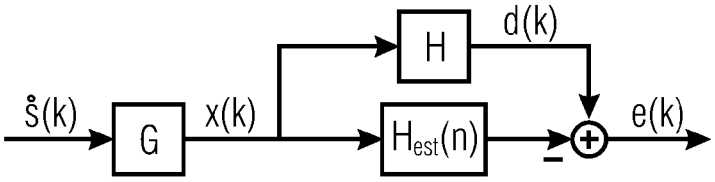
FIG. 6*a* shows a signal model for identifying a Loudspeaker Enclosure Microphone System (LEMS)
Figure 6B:
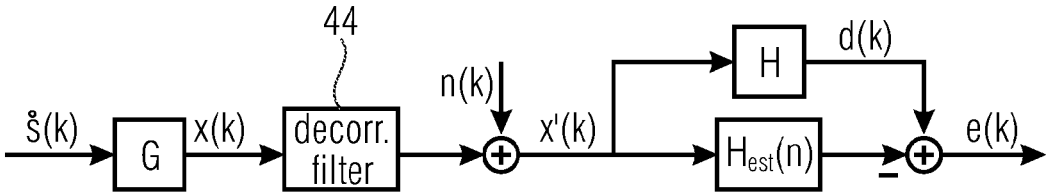
FIG. 6*b* shows a signal model of a method for estimating the system in accordance with FIG. 6*a* and for decorrelating loudspeaker signals.
Figure 6C:
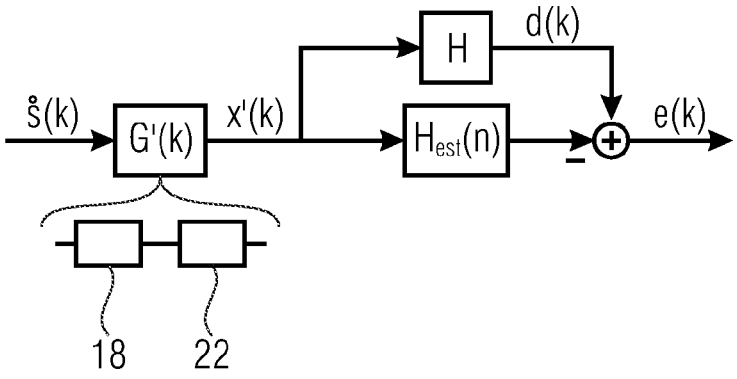
FIG. 6*c* shows a signal model of an MIMO system identification with loudspeaker decorrelation, as is described in FIGS. 1 and 2.

Subsequently, making reference to FIG. 4, while also referring to FIGS. 5*c* and 6*c*, one of a multitude of potential setups for verification of the inventive findings is described. FIG. 5*c* shows an exemplary course of an amplitude oscillation of a virtual source object over time. In FIG. 6*c*, a signal model of generating decorrelated loudspeaker signals by altering or modifying the acoustic playback scene is discussed. This is a prototype for illustrating the effects. The prototype is of an experimental setup as regards the loudspeakers and/or microphones used, the dimensions and/or distances between elements.

Figure 4:
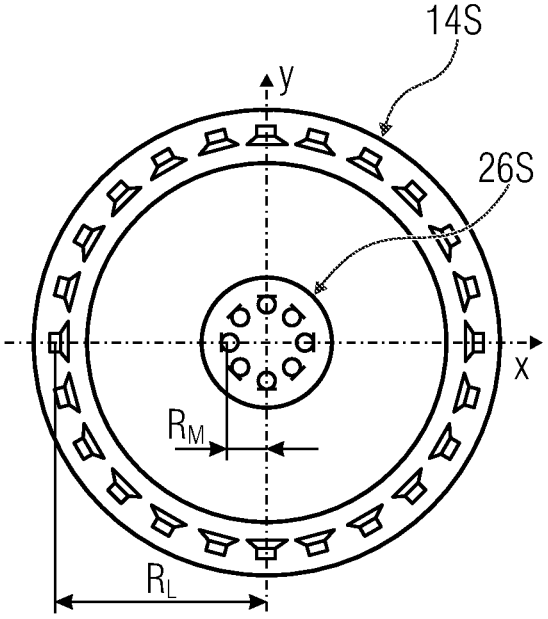
FIG. 4 shows a schematic arrangement of loudspeakers and microphones in an experimental prototype.

FIG. 4 shows a schematic arrangement of loudspeakers and microphones in an experimental prototype. An exemplary number of $N_L$=48 loudspeakers are arranged in a loudspeaker system 14S. The loudspeakers are arranged equidistantly on a circle line of a radius of, for example, 1.5 m so that the result is an exemplary angular distance of $2\pi/48=7.5°$. An exemplary number of $N_M$=10 microphones are arranged equidistantly in a microphone system 26S on a circle line of a radius $R_M$ of, for example, 0.05 m so that the microphones may exhibit an angle of 36° to one another. For test purposes, the setup is arranged in a space (enclosure of LEMS) with a reverberation time $T_{60}$ of about 0.3 seconds. The impulse responses may be measured with a sample frequency of 44.1 kHz, be converted to a sample rate of 11025 Hz and cut to a length of 1024 measuring points, which corresponds to the length of the adaptive filters for AEC. The LEMS is simulated by convoluting the impulse responses obtained with no noise on the microphone signal (near-end-noise) or local sound sources within the LEMS. These ideal laboratory conditions are selected in order to separate the influence of the method suggested on convergence of the adaption algorithm from other influences. Further experiments, for example including modeled near-end noise, may result in equivalent results.

The signal model is discussed in FIG. 6*c*. The decorrelated loudspeaker signals x'(k) here are input into the LEMS H, which may then be identified by a transfer function $H_{est}(n)$ based on the observations of the decorrelated loudspeaker signals x'(k) and the resulting microphone signals d(k). The error signals e(k) may capture reflections of loudspeaker signals at the enclosure, like the remaining echo. For AEC, a generalized adaptive filter algorithm in the frequency domain with an exponential forgetting factor $\lambda$=0.95, a step size $\mu$=0.5 (with $0\leq\mu\geq1$) and a frame shift of $L_F$=512, as is suggested in [SHK13], [BBK03], may be applied.

A measure of the system identification obtained is referred to as a normalized misalignment (NMA) and may be calculated by the following calculation rule:

$$\Delta_h(n) = 20\log_{10}\left(\frac{\|H_{est}(n) - H\|}{\|H\|_F}\right), \tag{17}$$

wherein $\|\bullet\|_F$ denotes the Frobenius norm and N the block time index. A small value of misalignment denotes system identification (estimation) of little deviation from the real system.

The relation between n and k may be indicated by n=floor(k/$L_F$), wherein floor(•) is the "floor" operator or the Gaussian bracket, i.e. the quotient is rounded off. Additionally, the echo cancellation obtained may be considered, which may, for example, be described by means of the Echo Return Loss Enhancement (ERLE), to achieve improved comparability to [SHK13].

The ERLE is defined as follows:

$$ERLE(k) = 20\log_{10}\left(\frac{\|d(k)\|_2}{\|e(k)\|_2}\right), \tag{18}$$

wherein $\|\bullet\|_2$ describes the Eucledean norm.

In a first experiment, the loudspeaker signals are determined in accordance with the wave field synthesis theory, as is suggested, for example, in [BDV93], in order to synthesize four planar waves at the same time with angles of incidence varying by $\alpha_q$. $\alpha_q$ is given by 0, $\pi/2$, $\pi$ and $3\pi/2$ for sources q=1, 2, . . . , $N_S$=4. The resulting time-varying angles of incidence may be described as follows:

$$\varphi_q(n) = \alpha_q + \varphi_a \cdot \sin\left(2\pi\frac{n}{L_P}\right), \tag{19}$$

wherein $\phi_a$ is the amplitude of the oscillation of the angle of incidence and $L_p$ is the period duration of the oscillation of the angle of incidence, as is exemplarily illustrated in FIG. 5*c*. Mutually uncorrelated signals of white noise were used for the source signals so that all 48 loudspeakers may be operated at equal average power.

Although noise signals for driving loudspeakers may hardly be relevant in practice, this scenario allows clear and concise evaluation of the influence of $\phi_a$. Considering the fact that, for example, exemplarily only four independent signal sources ($N_S$=4) and 48 loudspeakers ($N_L$=48) are arranged or are used, the object and the equation system of system identification are strongly under-determined such that a high normalized misalignment (NMA) is to be expected.

The prototype may obtain results of NMA which excel over the known technology and may thus result in an improved acoustic reproduction of WFS or HOA.

The results of the experiment are illustrated graphically in FIG. 5 as follows.

FIG. 5*a* shows the ERLE for the four sources of the prototype. Thus, the following applies: plot 1: $\phi_a=\pi/48$, plot 2: $\phi_a=4\pi/48$, plot 3: $\phi_a=8\pi/48$ and plot 4: $\phi_a=0$. For Plot 4 and, thus, for $\phi_a=0$, the ERLE of up to about 58 dB may be achieved.

FIG. 5*b* shows the normalized misalignment achieved with identical values for $\phi_a$ in plots 1 to 4. The misalignment may reach values of up to about −16 dB, which may, compared to values of −6 dB achieved in [SHK13], result in a marked improvement in the system description of the LEMS.

FIG. 5*c* shows a plot where time is given on the abscissa and the values of amplitude oscillation $\phi_a$ on the ordinate, so that the period duration $L_p$ may be read out.

The improvement compared to [SHK13] of up to 10 dB relative to the normalized misalignment may, at least partly, be explained by the fact that the approach, as is suggested in [SHK13], operates using spatially band-limited loudspeaker signals. The spatial bandwidth of a natural acoustic scene generally is too large so that the scene of loudspeaker signals and loudspeakers provided (to a limited extent) cannot be reproduced perfectly, i.e. without any deviations. By means of an artificial, i.e. controlled, band limitation, like, for example, in HOA, a spatially band-limited scene may be achieved. In alternative methods, like, for example, in WFS, aliasing effects occurring may be acceptable for obtaining a band-limited scene. Devices as are suggested in FIGS. 1 and 2 may operate using a spatially non-limited or hardly band-limited virtual playback scene. In [SHK13], aliasing artefacts of WFS generated or introduced already in the loudspeaker signals are simply rotated with the playback scene reproduced so that aliasing effects between the virtual source objects may remain. In FIGS. 5 and 6, the portions of the individual WFS aliasing terms in the loudspeaker signals may vary with a rotation of the virtual playback scene, by individually modifying the meta information of individual source objects. This may result in a stronger decorrelation. FIGS. 5*a-c* show that the system identification may be improved with larger a rotation amplitude $\phi_a$ of a virtual source object of the acoustic scene, as is shown in plot 3 of FIG. 5*b*, wherein a reduction of the NMA may be achieved at the expense of reduced echo cancellation, as plots 1-3 in FIG. 5*a* show compared to plot 4 (no rotation amplitude). However, the echo cancellation for the decorrelated loudspeaker signals ($\phi_a$>0) is improved over time, whereas the system identification does not for unaltered loudspeaker signals ($\phi_a$=0).

Different types of system identification will be described below in FIGS. 6*a-c*. FIG. 6*a* describes a signal model of system identification of a multiple input multiple output (MIMO) system, in which the non-uniqueness problem may occur. FIG. 6*b* describes a signal model of MIMO system identification with decorrelation of the loudspeaker signal in accordance with the known technology. FIG. 6*c* shows a signal model of MIMO system identification with decorrelation of loudspeaker signals, as may, for example, be achieved using a device of FIG. 1 or FIG. 2.

In FIG. 6*a*, the LEMS H is determined or estimated by $H_{est}$(n), wherein $H_{est}$(n) is determined or estimated by observing the loudspeaker signals x(k) and the microphone signals d(k). $H_{est}$(n) may, for example, be a potential solution of an under-determined system of equations. The vectors which capture the loudspeaker signals are defined as follows:

$$x(k)=(x_1(k),x_2(k), \ldots ,x_{N_L}(k))^T, \tag{1}$$

$$x_l(k)=(x_l(k-L_X+1),x_l(k-L_X+2), \ldots ,x_l(k))^T, \tag{2}$$

wherein $L_x$ describes the length of the individual component vectors $x_l$(k) which capture the samples $x_l$(k) of the loudspeaker signal l at a time instant k. The vectors which describe the microphone signals $L_D$ captured may also be defined to be recordings at certain time instants for each channel as follows:

$$d(k)=(d_1(k),d_2(k), \ldots ,d_{N_M}(k))^T, \tag{3}$$

$$d_m(k)=(d_m(k-L_D+1),d_m(k-L_D+2), \ldots ,d_m(k))^T. \tag{4}$$

The LEMS may then be described by linear MIMO filtering, which may be expressed as follows:

$$d(k)=Hx(k), \tag{5}$$

wherein the individual recordings of the microphone signals may be obtained by:

$$d_m(k) = \sum_{l=1}^{N_L} \sum_{\kappa=0}^{L_H-1} x_l(k-\kappa)h_{m,l}(\kappa). \tag{6}$$

The impulse responses $h_{m,l}(k)$ of the LEMS of a length $L_H$ may describe the LEMS to be identified. In order to express the individual recordings of the microphone signals by linear MIMO filtering, the relation between $L_X$ and $L_D$ may be defined by $L_X=L_D\ L_H-1$. The loudspeaker signals x(k) may be obtained by a reproduction system based on WFS, higher-order ambisonics or a similar method. The reproduction system may exemplary use linear MIMO filtering of a number of $N_S$ virtual source signals $\hat{\mathbf{s}}(k)$. The virtual source signals $\hat{\mathbf{s}}(k)$ may be represented by the following vector:

$$\hat{\mathbf{s}}(k)=(\hat{s}_1(k), \hat{s}_{N_S}(k))^T, \tag{7}$$

$$\hat{\mathbf{s}}_q(k)=(\hat{s}_q(k-L_S+1), \hat{s}_q(k-L_S+2), \ldots, \hat{s}_q(k))^T. \tag{8}$$

wherein $L_S$ is, for example, a length of the signal segment of the individual component $\hat{s}_q(k)$ and $\hat{s}_q(k)$ is the result of sampling the source q at a time k. A matrix G may represent the rendering system and be structured such that:

$$x(k)=G\,\hat{\mathbf{s}}(k), \tag{9}$$

describes the convolution of the source signals $\hat{s}_q(k)$ with the impulse response $g_{l,q}(k)$. This may be made use of to describe the loudspeaker signals $x_l(k)$ from the source signals $\hat{s}_q(k)$ in accordance with the following calculation rule:

$$x_l(k) = \sum_{q=1}^{N_S} \sum_{\kappa=0}^{L_R-1} \hat{s}_q(k-\kappa)g_{l,q}(\kappa), \tag{10}$$

The impulse responses $g_{l,q}(k)$ exemplarily comprise a length of $L_R$ samples and represent $R(l,q,\omega)$ in a discrete time domain.

The LEMS may be identified such that an error e(k) of the system estimation $H_{est}(n)$ may be determined by:

$$e(k)=d(k)-H_{est}(n)x(k) \tag{11}$$

and is minimized as regards a corresponding norm, such as, for example, the Euclidean or a geometrical norm. When selecting the Euclidean norm, the result may be the well-known Wiener-Hopf equations. When considering only finite impulse response (FIR) filters for the system responses, the Wiener-Hopf equations may be written or represented in matrix notation as follows:

$$R_{xx}H_{est}^H(n)=R_{xd} \tag{12}$$

with:

$$R_{xd}=\epsilon\{x(k)d^H(k)\} \tag{13}$$

wherein $R_{xd}$ exemplarily is the correlation matrix of the loudspeaker and microphone signals. $H_{est}(n)$ may only be unique when the correlation matrix $R_{xx}$ of the loudspeaker signals is full-rank. For $R_{xx}$, the following relation may be obtained:

$$R_{xx}=\epsilon\{x(k)x^H(k)\}=GR_{xx}G^H, \tag{14}$$

wherein $R_{ss}$ exemplarily is the correlation matrix of the source signals according to:

$$R_{xx}=\epsilon\{\hat{\mathbf{s}}(k)\hat{\mathbf{s}}^H(k)\}. \tag{15}$$

The result may be $L_S=L_X+L_R-1$, such that $R_{ss}$ comprises a dimension $N_S(L_X+L_R-1)\times N_S(L_X+L_R-1)$, whereas $R_{xx}$ comprises a dimension $N_L L_X \times N_L L_X$. A condition necessitated for $R_{xx}$ to be full-rank is as follows:

$$N_L L_X \leq N_S(L_X+L_R-1), \tag{16}$$

wherein the virtual sources carry at least uncorrelated signals and are located at different positions.

When the number of loudspeakers $N_L$ exceeds the number of virtual sources $N_S$, the non-uniqueness problem may occur. The influence of the impulse response lengths $N_X$ and $N_R$ will be ignored in the following discussion.

The non-uniqueness problem may at least partly result from the strong mutual cross-correlation of the loudspeaker signals which may, among other things, be caused by the small number of virtual sources. Occurrence of the non-uniqueness problem is the more probably, the more channels are used for the reproduction system, for example when the number of virtual source objects is smaller than the number of loudspeakers used in the LEMS. Known makeshift solutions aim at altering the loudspeaker signals such that the rank of $R_{xx}$ is increased or the condition number of $R_{xx}$ is improved.

FIG. 6*b* shows a signal model of a method of system estimation and decorrelation of loudspeaker signals. Correlated loudspeaker signals x(k) may, for example, be transferred to decorrelated loudspeaker signals x'(k) by decorrelation filters and/or noise-based approaches. Both approaches may be applied together or separately. A block 44 (decorrelation filter) of FIG. 6*b* describes filtering the loudspeaker signals $x_l(k)$ which may be different for each loudspeaker with an Index I and non-linear, as is described, for example, in [MHB01, BMS98]. Alternatively, filtering may be linear, but time-varying, as is suggested, for example, in [SHK23, Ali98, HBK07, WWJ12]. The noise-based approaches, as are suggested in [SMH95, GT98, GE98], may be represented by adding uncorrelated noise, indicated by n(k). It is common to these approaches that they neglect or leave unchanged the virtual source signals $\hat{\mathbf{s}}(k)$ and the rendering system G. They only operate on the loudspeaker signals x(k).

FIG. 6*c* shows a signal model of an MIMO system identification with loudspeaker decorrelation, as is described in FIGS. 1 and 2. A precondition necessitated for unique system identification is given by $$N_L L_X \leq N_S(L_X+L_R-1), \tag{16}$$

This condition applies irrespective of the actual spatial characteristics, like physical dimensions or emission characteristic of the virtual source objects. The respective virtual source objects here are positioned at mutually different positions in the respective playback space. However, different spatial characteristics of the virtual source objects may necessitate differing impulse responses which may be represented in G. In accordance with:

$$R_{xx}=\epsilon\{x(k)x^H(k)\}=GR_{ss}G^H, \tag{14}$$

G determines the correlation characteristics of the loudspeaker signals x(k), described by $R_{xx}$. Due to the non-uniqueness, there may be different sets of solutions for $H_{est}(n)$ in accordance with:

$$R_{xx}H_{est}^H(n)=R_{xd} \tag{12}$$

depending on the spatial characteristics of the virtual source objects. Since all the solutions from this set of solutions contain the perfect identification $H_{est}(n)=H$, irrespective of $R_{xx}$, a varying $R_{xx}$ may be of advantage for system identification, as is described in [SHK13].

An alteration of the spatial characteristics of virtual source objects may be made use of to improve system identification. This may be done by implementing a time-varying rendering system representable by G'(k). The time-varying rendering system G'(k) includes the modifier 18, as is, for example, discussed in FIG. 1, to modify the meta information of the virtual source objects and, thus, the spatial characteristics of the virtual source objects. The rendering system provides loudspeaker signals to the renderer 22 based on the meta information modified by the modifier 18 to reproduce the wave fields of different virtual source objects, like point sources, dipole sources, planar sources or sources of a kidney-shaped emission characteristic.

In contrast to descriptions as regards the rendering system G in FIGS. 6*a* and 6*b*, G'(k) of FIG. 6*c* is dependent on the time step k and may be variable for different time steps k. The renderer 22 directly produces the decorrelated loudspeaker signals x'(k) such that adding noise or a decorrelation filter may be dispensed with. The matrix G'(k) may be determined for each time step k in accordance with the reproduction scheme chosen, wherein the time instants k are temporally mutually different.

Although having described some aspects in connection with a device, it is to be understood that these aspects also represent a description of the corresponding method such that a block or element of a device is to be understood also to be a corresponding method step or feature of a method step. In analogy, aspects having been described in connection with or as a method step also represent a description of a corresponding block or detail or feature of a corresponding device.

Depending on the specific implementation requirements, embodiments of the invention may be implemented in either hardware or software. The implementation may be done using a digital storage medium, such as, for example, a floppy disc, DVD, Blu-ray disc, CD, ROM, PROM, EPROM, EEPROM or FLASH memory, a hard disc drive or a different magnetic or optical storage onto which are stored electronically readable control signals which may cooperate or cooperate with a programmable computer system such that the respective method will be executed. Therefore, the digital storage medium may be computer-readable. Some embodiments in accordance with the invention thus include a data carrier comprising electronically readable control signals which are able to cooperate with a programmable computer system such that one of the methods described herein will be executed.

Generally, embodiments of the present invention may be implemented as a computer program product comprising program code being operative to perform one of the methods when the computer program product runs on a computer. The program code may, for example, be stored on a machine-readable carrier.

Different embodiments comprise the computer program for performing one of the methods described herein, when the computer program is stored on a machine-readable carrier.

In other words, an embodiment of the inventive method is a computer program comprising program code for performing one of the methods described herein when the computer program runs on a computer. Another embodiment of the inventive method thus is a data carrier (or a digital storage medium or a computer-readable medium) onto which is recorded the computer program for performing one of the methods described herein.

Another embodiment of the inventive method thus is a data stream or a sequence of signals representing the computer program for performing one of the methods described herein. The data stream or the sequence of signals may, for example, be configured to be transferred via a data communications link, exemplarily via the internet.

Another embodiment includes processing means, for example a computer or programmable logic device, configured or adapted to perform one of the methods described herein.

Another embodiment includes a computer onto which is installed the computer program for performing one of the methods described herein.

In some embodiments, a programmable logic device (exemplarily a field-programmable gate array, FPGA) may be used to perform some or all functionalities of the methods described herein. In some embodiments, a field-programmable gate array may cooperate with a microprocessor in order to perform one of the methods described herein. Generally, the methods in some embodiments are performed by any hardware device which may be universally employable hardware, like a computer processor (CPU), or hardware specific to the method, like an ASIC, for example.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[Ali98] ALI, M.: Stereophonic Acoustic Echo Cancellation System Using Time Varying All-Pass filtering for signal decorrelation. In: IEEE International Conference on Acoustics, Speech, and Signal Processing (ICASSP) Bd. 6. Seattle, Wash., May 1998, pp. 3689-3692

[BBK03] BUCHNER, H.; BENESTY, J.; KELLERMANN, W.: Multichannel Frequency Domain Adaptive Algorithms with Application to Acoustic Echo Cancellation. In: BENESTY, J. (Hrsg.); HUANG, Y. (Hrsg.): Adaptive Signal Processing: Application to Real-World Problems. Berlin: Springer, 2003

[BDV93] BERKHOUT, A. J.; DE VRIES, D.; VOGEL, P.: Acoustic control by wave field synthesis. In: J. Acoust. Soc. Am. 93 (1993), Mai, pp. 2764-2778

[BLA97] Blauert, Jens: Spatial Hearing: the Psychophysics of Human Sound Localization. MIT press, 1997

[BMS98] BENESTY, J.; MORGAN, D. R.; SoNDHI, M. M.: A better understanding and an improved solution to the specific problems of stereophonic acoustic echo cancellation. In: IEEE Trans. Speech Audio Process. 6 (1998), March, No. 2, pp. 156-165

[Dan03] DANIEL, J.: Spatial sound encoding including near field effect: Introducing distance coding filters and a variable, new ambisonic format. In: 23rd International Conference of the Audio Eng. Soc., 2003

[GE98] GÄNSLER, T.; ENEROTH, P.: Influence of audio coding on stereophonic acoustic echo cancellation. In:

IEEE International Conference an Acoustics, Speech, and Signal Processing (ICASSP) vol. 6. Seattle, Wash., May 1998, pp. 3649-3652

[GT98] GILLOIRE, A.; TURBIN, V.: Using auditory properties to improve the behaviour of stereophonic acoustic echo cancellers. In: IEEE International Conference an Acoustics, Speech, and Signal Processing (ICASSP) vol. 6. Seattle, Wash., May 1998, pp. 3681-3684

[HBK07] HERRE, J.; BUCHNER, H.; KELLERMANN, W.: Acoustic Echo Cancellation for Surround Sound using Perceptually Motivated Convergence Enhancement. In: IEEE International Conference an Acoustics, Speech, and Signal Processing (ICASSP) vol. 1. Honolulu, Hi., April 2007, pp. I-17-I-20

[MHBOI] MORGAN, D. R.; HALL, J. L.; BENESTY, J.: Investigation of several types of nonlinearities for use in stereo acoustic echo cancellation. In: IEEE Trans. Speech Audio Process. 9 (2001), September, No. 6, pp. 686-696

[SHK13] SCHNEIDER, M.; HUEMMER, C.; KELLERMANN, W.: Wave-Domain Loudspeaker Signal Decorrelation for System Identification in Multichannel Audio Reproduction Scenarios. In: IEEE International Conference an Acoustics, Speech, and Signal Processing (ICASSP). Vancouver, Canada, May 2013

[SMH95] SoNDHI, M. M.; MORGAN, D. R.; HALL, J. L.: Stereophonic acoustic echo cancellation—An overview of the fundamental problem. In: IEEE Signal Process. Lett. 2 (1995), August, No. 8, pp. 148-151

[WWJ12] WUNG, J.; WADA, T. S.; JUANG, B. H.: Interchannel decorrelation by sub-band resampling in frequency domain. In: International Workshop on Acoustic Signal Enhancement {IWAENC). Kyoto, Japan, March 2012, pp. 29-32

[Bla97] Blauert, Jens: Spatial Hearing: the Psychophysics of Human Sound Localization. MIT press, 1997]

ABBREVIATIONS USED

AEC acoustic echo cancellation
FIR finite impulse response
HOA higher-order ambisonics
ILD interaural level difference
ITD interaural time difference
LEMS loudspeaker-enclosure-microphone system
LRE listening room equalization
MIMO multi-input multi-output
WFS wave field synthesis

The invention claimed is:

1. A device for generating a multitude of loudspeaker signals based on at least one virtual source object which comprises a source signal and meta information determining a position or type of the at least one virtual source object, comprising:

a modifier configured to time-varyingly modify the meta information; and a renderer configured to transfer the at least one virtual source object and the modified meta information in which the type or position of the at least one virtual source object is modified time-varyingly, to form a multitude of loudspeaker signals;

wherein the modifier is configured to at least one of:

modifying the meta information of the at least one virtual source object such that a virtual position of the at least one virtual source object is modified from one time instant to a later time instant and thereby a distance between the virtual position of the at least one virtual source object relative to a position in a playback space is altered by at most 25%;

modifying the meta information of the at least one virtual source object from one time instant to a later time instant such that, relative to a position in a playback space, an interaural level difference is increased by at most 26% or decreased by at most 21%;

modifying the meta information of the at least one virtual source object from one time instant to a later time instant such that, relative to a position in a playback space, a monaural level difference is increased by at most 26% or decreased by at most 21%; and modify the meta information of the at least one virtual source object from one time instant to a later time instant such that, relative to a position in a playback space, an interaural time difference is modified by at most 30 .mu.s.

2. The device in accordance with claim 1, further comprising:

a system calculator configured to estimate, based on a plurality of microphone signals and the multitude of loudspeaker signals, a transmission characteristic of a playback space where a plurality of loudspeakers which the multitude of loudspeaker signals is determined for and a plurality of microphones which the plurality of microphone signals originate from may be applied;

wherein the renderer is configured to calculate the multitude of loudspeaker signals based on the estimated transmission characteristic of the playback space.

3. The device in accordance with claim 1, wherein the renderer is configured to calculate the multitude of loudspeaker signals in accordance with the rule of a wave-field synthesis algorithm or a high-order ambisonic algorithm, or wherein the renderer is configured to calculate at least 10 loudspeaker signals.

4. The device in accordance with claim 1, wherein the modifier is configured to modify at least two virtual source objects such that the meta information of a first virtual source object are modified differently as regards position or type of the virtual source object compared to the meta information of a second virtual source object; and wherein the renderer is configured to calculate the multitude of loudspeaker signals based on the first modified meta information and the second modified meta information.

5. The device in accordance with claim 1, wherein the at least one virtual source object is arranged in the front relative to a listener in a playback space and the modifier is configured to modify the meta information of the at least one virtual source object from one time instant to a later time instant such that a direction of the at least one virtual source object relative to the listener is altered by less than 3°.

6. The device in accordance claim 1, wherein the at least one virtual source object is arranged in a lateral direction relative to a listener in a playback space and the modifier is configured to modify the meta information of the at least one virtual source object from one time instant to a later time instant such that a direction of the at least one virtual source object relative to the listener is altered by less than 10%.

7. The device in accordance with claim 1, wherein the modifier is configured to perform the meta information of the at least one virtual source object at a time interval of at least 10 seconds.

8. The device in accordance with claim 1, wherein the modifier is additionally configured to produce an image of the at least one virtual source object, wherein the image at least partly comprises the meta information of the at least one virtual source object; and wherein the modifier is configured to time-varyingly modify the meta information such that the at least one virtual source object and the image comprise mutually different meta information.

9. The device in accordance with claim 8, wherein the modifier is configured to position the image at a distance of at most 10 meters to the at least one virtual source object.

10. The device in accordance with claim 1, wherein the modifier is configured to modify the meta information of the at least one virtual source object of a playback scene reproduced as regards the position or type of the at least one virtual source object partly such that the modification of the playback scene reproduced is not noticeable by a listener in a playback space or not perceived as being disturbing.

11. The device in accordance with claim 1, wherein the renderer is additionally configured to add to the loudspeaker signals an attenuation or delay such that a correlation of the loudspeaker signals is reduced.

12. A method for generating a multitude of loudspeaker signals based on at least one virtual source object which comprises a source signal and meta information determining the position or type of the at least one virtual source object, comprising:

time-varyingly modifying the meta information; and transferring the at least one virtual source object and the modified information in which the type or position of the at least one virtual source object is modified time-varyingly, to form a multitude of loudspeaker signals;

wherein time-varyingly modifying the meta information is performed so as to at least one of:

modifying the meta information of the at least one virtual source object such that a virtual position of the at least one virtual source object is modified from one time instant to a later time instant and thereby a distance between the virtual position of the at least one virtual source object relative to a position in a playback space is altered by at most 25%;

modifying the meta information of the at least one virtual source object from one time instant to a later time instant such that, relative to a position in a playback space, an interaural level difference is increased by at most 26% or decreased by at most 21%;

modifying the meta information of the at least one virtual source object from one time instant to a later time instant such that, relative to a position in a playback space, a monaural level difference is increased by at most 26% or decreased by at most 21%; and modify the meta information of the at least one virtual source object from one time instant to a later time instant such that, relative to a position in a playback space, an interaural time difference is modified by at most 30 .mu.s.

13. A non-transitory digital storage medium having stored thereon a computer program for performing the method in accordance with claim 12 when said computer program is run by a computer.

* * * * *